US006916444B1

(12) United States Patent
Liang

(10) Patent No.: US 6,916,444 B1
(45) Date of Patent: Jul. 12, 2005

(54) WEAR RESISTANT ALLOY CONTAINING RESIDUAL AUSTENITE FOR VALVE SEAT INSERT

(75) Inventor: Xuecheng Liang, Green Bay, WI (US)

(73) Assignee: Alloy Technology Solutions, Inc., Marinette, WI (US)

( * ) Notice: Subject to any disclaimer, the term of this patent is extended or adjusted under 35 U.S.C. 154(b) by 211 days.

(21) Appl. No.: 10/074,068

(22) Filed: Feb. 12, 2002

(51) Int. Cl.[7] ..... C22C 38/44; C22C 38/56; C22C 38/34; C22C 30/00

(52) U.S. Cl. ..... 420/10; 420/12; 420/17; 420/97; 420/98; 420/108; 420/110; 420/586.1; 148/321; 148/324; 148/442; 75/246

(58) Field of Search ..... 420/10, 12, 17, 420/97, 98, 108, 110, 586.1; 148/321, 324, 442; 75/246

(56) References Cited

U.S. PATENT DOCUMENTS

| | | | |
|---|---|---|---|
| 4,155,754 | A | 5/1979 | Lynn |
| 4,778,522 | A | 10/1988 | Maki et al. |
| 4,844,024 | A | 7/1989 | Fujiki et al. |
| 5,316,596 | A | 5/1994 | Kataoka |
| 5,578,773 | A | 11/1996 | Wisell |
| 6,200,688 | B1 | 3/2001 | Liang et al. |
| 6,248,292 | B1 | 6/2001 | Ando et al. |

FOREIGN PATENT DOCUMENTS

| | | | |
|---|---|---|---|
| EP | 0 430 241 | A1 | 6/1991 |
| EP | 0 559 899 | A1 | 9/1993 |
| EP | 0 665 068 | A1 | 8/1995 |
| JP | 2-30730 | | 2/1990 |
| JP | 02030730 | | 2/1990 |
| JP | 3-13542 | | 1/1991 |
| JP | 03013542 | | 1/1991 |
| JP | 10-68041 | | 7/1993 |
| JP | 05179392 | | 7/1993 |
| JP | 05179394 | | 7/1993 |
| JP | 6-256889 | | 9/1994 |
| JP | 06256889 | | 9/1994 |
| JP | 08209299 | | 8/1996 |
| JP | 8-209299 | | 8/1996 |
| JP | 1068041 | | 3/1998 |
| JP | 10068041 | | 3/1998 |
| JP | 11061320 | | 3/1999 |
| JP | 2000-28009 | | 10/2000 |
| JP | 2000280009 | | 10/2000 |
| JP | 2001040458 | | 2/2001 |

*Primary Examiner*—Deborah Yee
(74) *Attorney, Agent, or Firm*—Reising, Ethington, Barnes, Kisselle, PlC.

(57) ABSTRACT

This invention related to a novel iron base alloy using residual austenite to improve wear resistance for valve seat insert material for internal combustion engines. The residual austenite is stable even after heat treatment and liquid nitrogen chilling. The alloy comprises of 2.0–4.0 wt % carbon, 1.0–3.0 wt % silicon, 0–4.0 wt % manganese, 3.0–9.0 wt % chromium, 5.0–15.0 wt % molybdenum, 3.0–15.0 wt % nickel, 0–6.0 wt % vanadium, 0–4.0 wt % niobium, 0–6.0 wt % cobalt, and the balance being iron with impurities.

33 Claims, 4 Drawing Sheets

WEAR RESISTANT ALLOY CONTAINING RESIDUAL AUSTENITE FOR VALVE SEAT INSERT

BACKGROUND OF THE INVENTION

1. Field of the Invention

This invention relates to a wear resistant iron base alloy containing large amount of stable residual austenite to improve wear resistance as engine valve seat inserts (VSI). The inventive alloy is especially useful to make intake valve seat inserts used in heavy duty internal combustion engines where the working temperature is not high enough to form high oxidizing atmosphere to promote the formation of protective oxides on the surfaces of VSI's. In a further aspect, this invention relates to components made from such alloys, either cast or hardfaced. Alternatively, components made of such alloys may be made by conventional powder metallurgy methods either by cold pressing and sintering or by hot pressing at elevated pressures for wear resistant applications.

2. Background Art

Wear resistance and wear compatibility with common valve alloys are important properties for intake valve seat insert alloys used in internal combustion engines, where the average intake VSI working temperature is around 400–650° F. and wear compatibility is defined as the tendency to damage the mating valve or valve facing alloys. Currently, iron base and cobalt base alloys are commonly used for intake valve seat inserts in diesel or dry fuel internal combustion engines. Because of the low cost, iron base alloys, like high chromium iron base alloys and high speed tool steel type alloys, are widely used as intake VSI materials in engines with medium or light loading conditions. Large amount of alloy carbides and hard martensite matrix are the essential factors for good wear resistance of these iron base alloys. However, these alloys can not provide enough wear resistance or wear compatibility in many new internal combustion engines with higher power output and less emission. Although cobalt base alloys like Stellite® 3 or Tribaloy® T-400 can offer enough wear resistance as intake VSI materials in certain demanding applications, the high cost of cobalt element limits these cobalt base alloys to be widely accepted in the engine industry.

There are also many tool steels or other iron base alloy patents for wear resistant applications. U.S. Pat. No. 4,778,522, U.S. Pat. No. 4,155,754, U.S. Pat. No. 4,844,024, are a few examples of tool steel type wear resistant alloys.

U.S. Pat. No. 4,021,205 discloses a sintered powdered ferrous alloy article, in which carbon is 1.0–4.0%, chromium 10.0–30.0 wt %, nickel 2.0–15.0%, molybdenum 10.0–30.0%, cobalt 20.0–40.0%, niobium 1.0–5.0%, and the balance being iron.

U.S. Pat. No. 6,248,292 discloses an iron base overlaying alloy for internal combustion valves. This alloy contains carbon 0.5–3.0%, molybdenum 20.0–70.0%, nickel 5.0–40.0%, and the balance being Fe. In conditions where oxides are easily formed, the overlaying alloy has the following composition: carbon 0.5–3.0%, chromium 0.1–10.0%, molybdenum 20.0–60.0%, nickel 5.0–40.0%, and the balance being iron and unavoidable impurities.

Japanese Patent Publication 59-229465 discloses an iron base alloy with excellent wear resistance by incorporating a specific ratio of C, Cr, Nb, Mo, W, V and Ta in Fe. This alloy contains carbon 1.0–3.0%, chromium 10.1–20.0%, niobium 0.2–5.0%, one or two kinds among molybdenum 0.5–10.0%, tungsten 0.5–10.0%, vanadium 0.5–5.0%, tantalum 0.2–5.0%.

U.S. Pat. No. 5,316,596 discloses a roll shell steel with carbon 1.5–3.5%, silicon 1.5% or less, manganese 1.2% or less, chromium 5.5–12.0%, molybdenum 2.0–8.0%, niobium 0.6–7.0% vanadium 3.0–10.0%, and satisfies the formulae: $V+1.8Nb<7.5C-6.0\%$, $0.2<Nb/V<0.8$, and remainder of Fe and inherent impurities.

U.S. Pat. No. 5,578,773 discloses a powder metallurgy high speed steel with carbon 2.2–2.7%, silicon 1.0% or less, manganese from trace to 1.0%, chromium 3.5–4.5%, molybdenum 2.5–4.5%, tungsten 2.5–4.5%, vanadium 7.5–9.5%, and remainder of Fe and inherent impurities.

It is an object of this invention to develop an iron base alloy with improved wear compatibility and wear resistance for VSI application.

SUMMARY OF THE INVENTION

A novel iron base alloy has been invented that has a unique microstructure to provide better wear resistance and compatibility with mating valve facing alloys. The microstructure of the inventive alloys is composed of alloy carbides and a stable austenite plus small amount of martensite matrix. The combination of a large amount of residual austenite and a small amount of martensite offers better wear resistance and wear compatibility than pure martensite matrix type alloys used in traditional iron base VSI alloys. The existence of martensite in the matrix increases the hardness of the inventive alloys that is an important parameter to indentation resistance of VSI. Therefore it is an objective of the alloy to have hardness between 45–55 HRC. It is known that a small amount of residual austenite in tool steels has a complex effect to the wear resistance of the tool steels. Unfortunately even when residual austenite has a positive effect to the wear resistance, the residual austenite is thermodynamically unstable and will decompose into martensite in liquid nitrogen temperature, high working temperature or even in room temperature. Phase transformation from austenite to martensite can significantly increase the outer diameter of VSI depending on the amount of residual austenite transformed, as austenite has a higher density than martensite. Liquid nitrogen or dry ice sometimes is used to cool VSI in order to install VSI into engine heads. In VSI containing unstable residual austenite the outer diameter of VSI will increase to offset the size reduction due to cooling in liquid nitrogen, making it difficult to install these VSI to engine head. In the inventive alloys, the stability of residual austenite has been greatly improved through carefully controlling the chemical compositions to a specific range, and most of the residual austenite in the inventive alloys is stable even cooling down to liquid nitrogen temperature.

In one aspect, the present invention is an alloy with the following composition:

| Element | wt. % |
|---|---|
| Carbon | 2.0–4.0 |
| Silicon | 1.0–3.0 |
| Chromium | 3.0–9.0 |
| Manganese | 0.0–4.0 |
| Molybdenum | 5.0–15.0 |
| Tungsten | 0.0–6.0 |

-continued

| Element | wt. % |
|---|---|
| Vanadium | 0.0–6.0 |
| Niobium | 0.0–4.0 |
| Nickel | 3.0–15.0 |
| Cobalt | 0–6.0 |
| Iron | balance |

In another aspect of the invention, metal components are either made of the alloy, such as by casting, or powder metallurgy method by forming from a powder and sintering. Furthermore, the alloy is used to hardface the components as the protective coating.

DETAILED DESCRIPTION OF THE INVENTION AND PREFERRED EMBODIMENTS

The microstructure of most traditional VSI iron base alloys, like high speed steels and high chromium type alloys, consists of hard alloy carbides and tempered martensite matrix to achieve good wear resistance. The tempered martensite is also strengthened by solution atoms like tungsten, molybdenum and chromium, and the like. The tool steel type alloy design principle has been proved to be effective to obtain high wear resistance in different cutting tools where high hot hardness is essential to retain a sharp edge in high temperature during cutting operation. Wear of intake VSI is the accumulated effects of high normal contact and shear stresses after multiple open and close cycles under high frequency. The typical average intake VSI working temperature is only around 200–300° C., not high enough to form protective oxides when engines are running very clean. Subsurface crack formation and propagation are one of the major mechanisms for the loss of intake VSI material. Alloys with both hard and soft matrix would have better wear resistance that those only with hard or soft matrix for intake VSI application, as soft matrix is beneficial to reduce the crack formation rate and also to blunt sharp cracks to stop crack propagation. The hard matrix provides a necessary indentation resistance to the material. However, the biggest difficulty in the inventive alloys is how to make residual austenite stable under intake VSI working temperature or even under liquid nitrogen without changing into martensite, because chilling in liquid nitrogen is a common process for VSI installation process. The phase transformation from austenite into martensite is a volume increase process and therefore resulting in an increase in VSI dimensions. A significant VSI size gain due to the phase transformation makes it difficult to install VSI into engine heads. After extensive experimental study, it is found that the stability of residual austenite can be greatly enhanced in the inventive alloys through controlling chemical compositions to a specific range.

Figure 1:
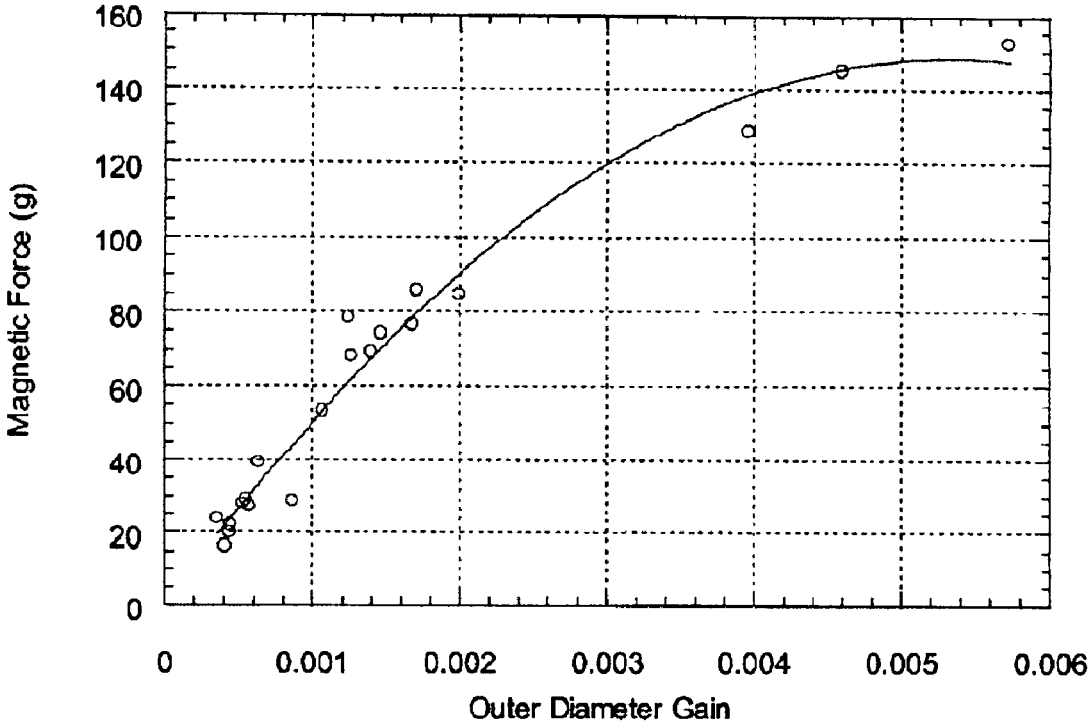
FIG. 1 is a graph of a valve seat insert outer diameter change versus magnetic force after heat treatment and liquid nitrogen chilling.

A simple and effective magnetic balance testing method is used to examine the stability of residual austenite in many sample alloys. A ring-shaped sample is placed on a balance with precision to 0.01 gram and then an iron-neodymium-boron permanent magnet with dimensions of 3 mm diameter and 4 mm thickness is placed above the ring sample. The spacing between the magnet and the sample is 1.27 mm. The weight of each testing sample is recorded with or without the magnetic. The difference in weight with and without the magnet is the magnetic attraction force. Since residual austenite is ferri-magnetic and martensite is ferro-magnetic, the more residual austenite in a sample alloy, the less the magnetic attraction force. FIG. 1 is a graph of VSI size change versus the magnetic force. In practice, the residual austenite is stable if the room temperature size change is less than 0.025 mm after chilling in liquid nitrogen, which means the residual is stable if the magnetic force is less than 50 gram after liquid nitrogen treatment. As shown in table 2, the magnetic force of M2 tool with 100% martensite matrix is about 160 gram while the magnetic force of a nickel base alloy with 100% austenite is about 0.4 gram. To the first approximation, the content of martensite in a sample alloy can be estimated as being roughly proportional to the magnetic force.

A high temperature pin-on-disk wear tester was used to measure the sliding wear resistance of the alloys because sliding wear is the common wear mode in valve seat insert wear due to the relative sliding motion of valve against valve seat insert in internal combustion engines. The pin specimen with dimensions of 6.35 mm diameter and approximate 25.4 mm long was made of valve alloys. The disk was made of insert alloys having dimensions of 50.8 mm and 12.5 mm in diameter and thickness respectively. The tests were performed with reference to ASTM G99–90. The disk was rotated at a velocity of 0.13 m/s for a total sliding distance of 255 m. The weight loss was measured on both the pin and the disk samples after each test using a balance with 0.1 mg precision. Eatonite 6 was used as the pin alloy because it is a common valve facing alloy. Eatonite 6 is an austenitic iron base alloy developed by Eaton Corporation.

Sample alloys No. 1–6 contain 2.40 wt % carbon, 2.0 wt % silicon, 6.0 wt % chromium, 5.0 wt % molybdenum, 4.0 wt % vanadium, 0–12.0 wt % nickel, and the balance being iron with a small amount of impurities.

Sample alloy No. 7 contains 1.6 wt % carbon, 2.0 wt % silicon, 0.4 wt % manganese, 6.0 wt % chromium, 5.0 wt % molybdenum, 4.0 wt % vanadium, 1.0 wt % niobium, and the balance being iron with a small amount of impurities.

Sample alloy No. 8 contains 1.8 wt % carbon, 2.0 wt % silicon, 0.4 wt % manganese, 6.0 wt % chromium, 5.0 wt % molybdenum, 5.0 wt % vanadium, 2.0 wt % niobium, and the balance is iron with a small amount of impurities. Sample alloy No. 9 contains 3.0 wt % carbon, 2.0 wt % silicon, 0.4 wt % manganese, 6.0 wt % chromium, 20.0 wt % molybdenum, 1.0 wt % vanadium, 1.0 wt % niobium, and the balance being iron with a small amount of impurities.

Sample alloys No. 10–13 contain 2.5 wt % carbon, 2.0 wt % silicon, 0.4 wt % manganese, 12.0 wt % molybdenum, 1.5 wt % tungsten, 2.0 wt % vanadium, 1.5 wt % niobium, 8.0 wt % nickel, 3.0–12.0 wt % chromium, and the balance being iron with a small amount of impurities.

Sample alloys No. 14–16 contain 2.5 wt % carbon, 2.0 wt % silicon, 0.4 wt % manganese, 6.0 wt % chromium, 12.0 wt % molybdenum, 1.5 wt % tungsten, 2.0 wt % vanadium, 0–2.5 wt % niobium 8.0 wt % nickel, and the balance being iron with a small amount of impurities.

Sample alloys No. 17 contains 2.4 wt % carbon, 2.0 wt % silicon, 0.4 wt % manganese, 6.0 wt % chromium, 5.0 wt % molybdenum, 4.0 wt % vanadium, 8.0 wt % nickel, and the balance being iron with a small amount of impurities. Sample alloys No. 18–19 contain 2.5 wt % carbon, 2.0 wt % silicon, 0.4 wt % manganese, 6.0 wt % chromium, 8.0–10.0 wt % molybdenum, 1.5 wt % tungsten, 2.0 wt % vanadium, 1.5 wt % niobium, 8.0 wt % nickel, and the balance being iron with a small amount of impurities. Sample alloy No. 20 contains 2.2 wt % carbon, 2.0 wt % silicon, 0.4 wt % manganese, 6.0 wt % chromium, 15.0 wt % molybdenum, 2.0 wt % vanadium, 8.0 wt % nickel, and the balance being iron with a small amount of impurities.

Sample alloy No. 21 contains 2.5 wt % carbon, 2.0 wt % silicon, 0.4 wt % manganese, 6.0 wt % chromium, 12.0 wt % molybdenum, 4.0 wt % vanadium, 1.5 wt % niobium, 8.0 wt % nickel, and the balance being iron with a small amount of impurities.

Sample alloy No. 22 contains 2.5 wt % carbon, 2.0 wt % silicon, 2.0 wt % manganese, 6.0 wt % chromium, 6.0 wt % molybdenum, 6.0 wt % tungsten, 2.0 wt % vanadium, 1.5 wt % niobium, 8.0 wt % nickel, and the balance being iron with a small amount of impurities.

Sample alloy No. 23 contains 2.5 wt % carbon, 2.0 wt % silicon, 0.4 wt % manganese, 6.0 wt % chromium, 12.0 wt % molybdenum, 1.5 wt % tungsten, 2.0 wt % vanadium, 1.5 wt % niobium, 6.0 wt % cobalt, 8.0 wt % nickel, and the balance being iron with a small amount of impurities.

Sample alloy No. 24 contains 2.5 wt % carbon, 1.0 wt % silicon, 0.4 wt % manganese, 5.0 wt % chromium, 12.0 wt % molybdenum, 2.5 wt % vanadium, 1.5 wt % niobium, 8.0 wt % nickel, and the balance being iron with a small amount of impurities.

Sample alloy No. 25 contains 0.9 wt % carbon, 2.0 wt % silicon, 0.4 wt % manganese, 5.0 wt % chromium, 8.0 wt % molybdenum, 1.0 wt % vanadium, 6.0 wt % nickel, and the balancing iron with a small amount of impurities.

Sample alloy No. 26 contains 2.5 wt % carbon, 4.0 wt % silicon, 2.0 wt % manganese, 6.0 wt % chromium, 12.0 wt % molybdenum, 2.0 wt % vanadium, 3.0 wt % niobium, 8.0 wt % nickel, and the balance being iron with a small amount of impurities.

Sample alloy No. 27–30 are commercially available alloys as comparative example. Specimens of the above sample alloys were cast and machined for magnetic, wear and hardness test. The nominal compositions of these sample alloys are listed in table 1.

TABLE I

| | Alloy Chemical Compositions (wt %) | | | | | | | | | |
|---|---|---|---|---|---|---|---|---|---|---|
| Sample Alloy (Trade Name) | C | Si | Mn | Cr | Mo | W | Fe | V | Nb | Ni |
| 1 (comparative) | 2.4 | 2.0 | 0.4 | 6.0 | 5.0 | — | Bal. | 4.0 | — | — |
| 2 | 2.4 | 2.0 | 0.4 | 6.0 | 5.0 | — | Bal. | 4.0 | — | 3.0 |
| 3 | 2.4 | 2.0 | 0.4 | 6.0 | 5.0 | — | Bal. | 4.0 | — | 6.0 |
| 4 | 2.4 | 2.0 | 0.4 | 6.0 | 5.0 | — | Bal. | 4.0 | — | 8.0 |
| 5 | 2.4 | 2.0 | 0.4 | 6.0 | 5.0 | — | Bal. | 4.0 | — | 10.0 |
| 6 | 2.4 | 2.0 | 0.4 | 6.0 | 5.0 | — | Bal. | 4.0 | — | 12.0 |
| 7 (comparative) | 1.6 | 2.0 | 0.4 | 6.0 | 5.0 | — | Bal. | 4.0 | 1.0 | — |
| 8 (comparative) | 1.8 | 2.0 | 0.4 | 6.0 | 5.0 | — | Bal. | 5.0 | 2.0 | — |
| 1 (comparative) | 2.4 | 2.0 | 0.4 | 6.0 | 5.0 | — | Bal. | 4.0 | — | — |
| 9 (comparative) | 3.0 | 2.0 | 0.4 | 6.0 | 20.0 | — | Bal. | 1.0 | 1.0 | — |
| 10 | 2.5 | 2.0 | 0.4 | 3.0 | 12.0 | 1.5 | Bal. | 2.0 | 1.5 | 8.0 |
| 11 | 2.5 | 2.0 | 0.4 | 6.0 | 12.0 | 1.5 | Bal. | 2.0 | 1.5 | 8.0 |
| 12 | 2.5 | 2.0 | 0.4 | 9.0 | 12.0 | 1.5 | Bal. | 2.0 | 1.5 | 8.0 |
| 13 (comparative) | 2.5 | 2.0 | 0.4 | 12.0 | 12.0 | 1.5 | Bal. | 2.0 | 1.5 | 8.0 |
| 14 | 2.5 | 2.0 | 0.4 | 6.0 | 12.0 | 1.5 | Bal. | 2.0 | — | 8.0 |
| 15 | 2.5 | 2.0 | 0.4 | 6.0 | 12.0 | 1.5 | Bal. | 2.0 | 1.5 | 8.0 |
| 16 | 2.5 | 2.0 | 0.4 | 6.0 | 12.0 | 1.5 | Bal. | 2.0 | 2.5 | 8.0 |
| 17 | 2.4 | 2.0 | 0.4 | 6.0 | 5.0 | — | Bal. | 4.0 | — | 8.0 |
| 18 | 2.5 | 2.0 | 0.4 | 6.0 | 8.0 | 1.5 | Bal. | 2.0 | 1.5 | 8.0 |
| 19 | 2.5 | 2.0 | 0.4 | 6.0 | 10.0 | 1.5 | Bal. | 2.0 | 1.5 | 8.0 |
| 11 | 2.5 | 2.0 | 0.4 | 6.0 | 12.0 | 1.5 | Bal. | 2.0 | 1.5 | 8.0 |
| 20 | 2.2 | 2.0 | 0.4 | 6.0 | 15.0 | — | Bal. | 2.0 | — | 8.0 |
| 11 | 2.5 | 2.0 | 0.4 | 6.0 | 12.0 | 1.5 | Bal. | 2.0 | 1.5 | 8.0 |
| 21 | 2.5 | 2.0 | 0.4 | 6.0 | 12.0 | 1.5 | Bal. | 4.0 | 1.5 | 8.0 |
| 11 | 2.5 | 2.0 | 0.4 | 6.0 | 12.0 | 1.5 | Bal. | 2.0 | 1.5 | 8.0 |
| 22 | 2.5 | 2.0 | 2.0 | 6.0 | 6.0 | 6.0 | Bal. | 2.0 | 1.5 | 8.0 |
| 11 | 2.5 | 2.0 | 0.4 | 6.0 | 12.0 | — | Bal. | 2.0 | 1.5 | 8.0 |
| 23 | 2.5 | 2.0 | 0.4 | 6.0 | 12.0 | 1.5 | Bal. | 2.0 | 1.5/ Co | 8.0 |
| 24 | 2.5 | 1.0 | 0.4 | 5.0 | 12.0 | — | Bal. | 2.5 | 1.5 | 8.0 |
| 11 | 2.5 | 2.0 | 0.4 | 6.0 | 12.0 | 1.5 | Ba1. | 2.0 | 1.5 | 8.0 |
| 25 (comparative) | 0.9 | 2.0 | 0.4 | 5.0 | 8.0 | 2.0 | Bal. | 1.0 | — | 6.0 |
| 3 | 2.4 | 2.0 | 0.4 | 6.0 | 5.0 | — | Bal. | 4.0 | — | 6.0 |
| 26 | 2.5 | 4.0 | 2.0 | 6.0 | 12.0 | 1.5 | Bal. | 2.0 | 3.0 | 8.0 |
| 11 | 2.5 | 2.0 | 0.4 | 6.0 | 12.0 | 1.5 | Bal. | 2.0 | 1.5 | 8.0 |
| 27 (M2 too steel) | 1.6 | 0.4 | 0.5 | 4.0 | 6.5 | 5.5 | 79.1 | 1.5 | | |

TABLE I-continued

| Sample Alloy (Trade Name) | Alloy Chemical Compositions (wt %) | | | | | | | | | |
|---|---|---|---|---|---|---|---|---|---|---|
| | C | Si | Mn | Cr | Mo | W | Fe | V | Nb | Ni |
| 28 (Silchrome XB) | 1.5 | 2.4 | 0.5 | 20.0 | 0.2 | 0.2 | 73.6 | — | — | 1.2 |
| 29 (Eatonite 2) | 2.3 | 0.7 | 0.1 | 29.5 | — | 15.0 | 5.0 | — | — | 47.2 |
| 30 (Eatonite 6) | 1.6 | 1.2 | 0.7 | 30.0 | 5.0 | — | Bal. | — | — | 16.5 |

TABLE 2

| Sample Alloy | Wear Test Results | |
|---|---|---|
| | Pin Weight Loss (mg) | Disk Weight Loss (mg) |
| 1 | 2.7 | 18.73 |
| 1 (As cast) | 1.55 | 8.55 |
| 10 | 1.8 | 2.7 |
| 11 | 0.9 | 3.1 |
| 12 | 3.2 | 3.7 |
| 13 | 1.9 | 9.6 |
| 14 | 0.5 | 2.5 |
| 15 | 0.7 | 2.8 |
| 16 | 1.0 | 2.3 |
| 19 | 0.4 | 3.3 |
| 21 | 1.0 | 2.5 |
| 22 | 2.2 | 2.9 |
| 23 | 1.8 | 3.7 |
| 26 | 1.1 | 4.1 |
| 27 | 5.3 | 45.1 |
| 28 | 3.5 | 58.6 |

TABLE 3

| Example Alloy | Magnetic Force Test (gram) | | |
|---|---|---|---|
| | (As Cast) | 593° C.-1 hr | 593° C.-1 hr + LN |
| 1 (Ni 0%) | 51.85 | 114.88 | 144.24 |
| 2 (Ni 3%) | 21.26 | 62.13 | 121.64 |
| 3 (Ni 6%) | 7.40 | 30.40 | 75.41 |
| 4 (Ni 8%) | 3.52 | 6.01 | 42.45 |
| 5 (Ni 10%) | 0.88 | 1.16 | 19.57 |
| 6 (Ni 12%) | 1.11 | 1.69 | 29.47 |
| 7 (C 1.6%) | 129.05 | 133.69 | |
| 8 (C 1.8%) | 130.96 | 125.36 | 144.01 |
| 1 (C 2.4%) | 51.85 | 114.88 | 144.24 |
| 9 (C 3.0%) | 30.30 | 89.45 | 113.21 |
| 10 (Cr 3%) | 1.51 | 17.44 | 97.94 |
| 11 (Cr 6%) | 1.81 | 4.65 | 20.72 |
| 12 (Cr 9%) | 5.59 | 10.40 | 27.00 |
| 13 (Cr 12%) | 10.50 | 13.50 | 25.66 |
| 14 (Nb 0%) | 3.76 | 8.51 | 46.99 |
| 15 (Nb 1.5%) | 1.81 | 4.65 | 20.72 |
| 16 (Nb 2.5%) | 3.01 | 6.03 | 30.00 |
| 17 (Mo 5%) | 3.52 | 6.01 | 42.45 |
| 18 (Mo 8%) | 2.44 | 4.21 | 39.26 |
| 19 (Mo 10%) | 2.95 | 5.52 | 36.04 |
| 11 (Mo 12%) | 1.81 | 4.65 | 20.72 |
| 20 (Mo 15%) | 1.12 | 2.80 | 23.03 |
| 11 (V 2.0%) | 1.81 | 4.65 | 20.72 |
| 21 (V 4%) | 1.74 | 3.63 | 37.86 |
| 22 (Mo 6%, W 6%) | 6.21 | 15.10 | 48.22 |
| 11 (Mo 12%) | 1.81 | 4.65 | 20.72 |
| 11 (Co 0%) | 1.81 | 4.65 | 20.72 |
| 23 (Co 6%) | 1.66 | 4.41 | 30.33 |
| 24 (Si 1.0%) | 0.70 | 1.05 | 2.95 |
| 11 (Si 2%) | 1.81 | 4.65 | 20.72 |
| 25 (C 0.9%) | 17.73 | 56.52 | 135.20 |
| 3 (C 2.4%) | 7.40 | 30.40 | 75.41 |
| 11 (Mn 0.4%) | 1.81 | 4.65 | 20.72 |
| 26 (Mn 2.0%) | 1.07 | 7.15 | 21.16 |
| 29 (Eatonite 2) | 0.16 | 0.16 | 0.15 |
| 30 (Eatonite 6) | 0.28 | 0.31 | 0.30 |

TABLE 4

| Example Alloy | Hardness of Some Sample Alloys in different states (HRC) | | |
|---|---|---|---|
| | As Cast | 1100 F-1 hr | 1100 F-1 hr + LN |
| 1 (Ni 0%) | 53.1 | 61.6 | 64.2 |
| 2 (Ni 3%) | 49.4 | 54.8 | 60.4 |
| 3 (Ni 6%) | 48.4 | 49.6 | 56.0 |
| 4 (Ni 8%) | 42.9 | 49.4 | 51.6 |
| 5 (Ni 10%) | 39.6 | 48.3 | 48.6 |
| 6 (Ni 12%) | 40.9 | 47.8 | 50.4 |
| 7 (C 1.6%) | 61.5 | 62.3 | 61.5 |
| 8 (C 1.8%) | 60.7 | 61.0 | 61.6 |
| 1 (C 2.4%) | 53.1 | 61.6 | 64.2 |
| 9 (C 3.0%) | 64.4 | 65.9 | 70.0 |
| 10 (Cr 3%) | 46.0 | 49.0 | 57.4 |
| 11 (Cr 6%) | 48.7 | 52.6 | 53.8 |
| 12 (Cr 9%) | 46.8 | 51.7 | 52.6 |
| 13 (Cr 12%) | 45.3 | 49.5 | 48.6 |
| 14 (Nb 0%) | 46.4 | 52.4 | 54.8 |
| 15 (Nb 1.5%) | 46.4 | 51.2 | 54.2 |
| 16 (Nb 2.5%) | 48.4 | 50.1 | 53.6 |
| 17 (Mo 5%) | 42.9 | 49.4 | 51.6 |
| 18 (Mo 8%) | 46.4 | 51.2 | 54.2 |
| 19 (Mo 10%) | 48.3 | 52.5 | 54.7 |
| 11 (Mo 12%) | 48.7 | 52.6 | 53.8 |
| 20 (Mo 15%) | 47.4 | 48.6 | 49.5 |
| 11 (V 2.0%) | 48.7 | 52.6 | 53.8 |
| 21 (V 4%) | 47.3 | 50.1 | 53.7 |
| 22 (Mo 6%, W 6%) | 44.8 | 52.0 | 53.3 |
| 11 (Mo 12%) | 48.7 | 52.6 | 53.8 |
| 11 (Co 0%) | 1.81 | 4.65 | 20.72 |
| 23 (Co 6%) | 1.66 | 4.41 | 30.33 |
| 24 (Si 1.0%) | 0.70 | 1.05 | 2.95 |
| 11 (Si 2%) | 1.81 | 4.65 | 20.72 |
| 25 (C 0.9%) | 17.73 | 56.52 | 135.20 |
| 3 (C 2.4%) | 7.40 | 30.40 | 75.41 |
| 11 (Mn 0.4%) | 1.81 | 4.65 | 20.72 |
| 26 (Mn 2.0%) | 1.07 | 7.15 | 21.16 |

Sample alloy No. 1 contains about 60% residual austenite in as-cast state. The heat and chilling treatment changes the residual austenite into martensite in sample alloy No. 1 as shown in table 3 and table 4, where the hardness of heat and chilling treated sample alloy No. 1 is 64.2 HRC, much higher than that in as-cast state (53.1 HRC) due to phase transformation. The amount of wear is 21.4 mg for example alloy No. 1 with 100% martensite matrix while the amount of wear is 10.1 mg for the same alloy containing about 60% residual austenite in as-cast condition. Thus, wear test results indicate that residual austenite can significantly improve sliding wear resistance at intermediate temperature (260° C.) even with a much lower hardness when comparing example alloy No. 1 in as-cast versus 593° C. for 1 hour and liquid nitrogen chilling treatment. So the objective now changes into how to make residual austenite stable even after heat and liquid nitrogen chilling treatment. Wear test results of some other sample alloys are also listed in Table 2.

Figure 2:
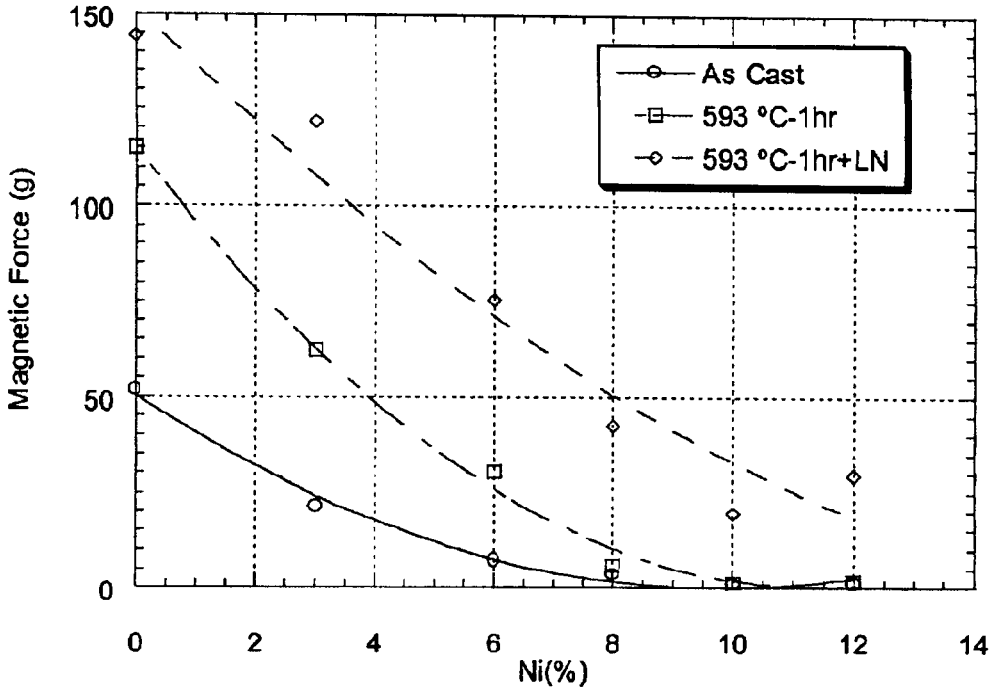
FIG. 2 is a graph illustrating the effect of nickel content on the magnetic force of example alloys.
Figure 3:
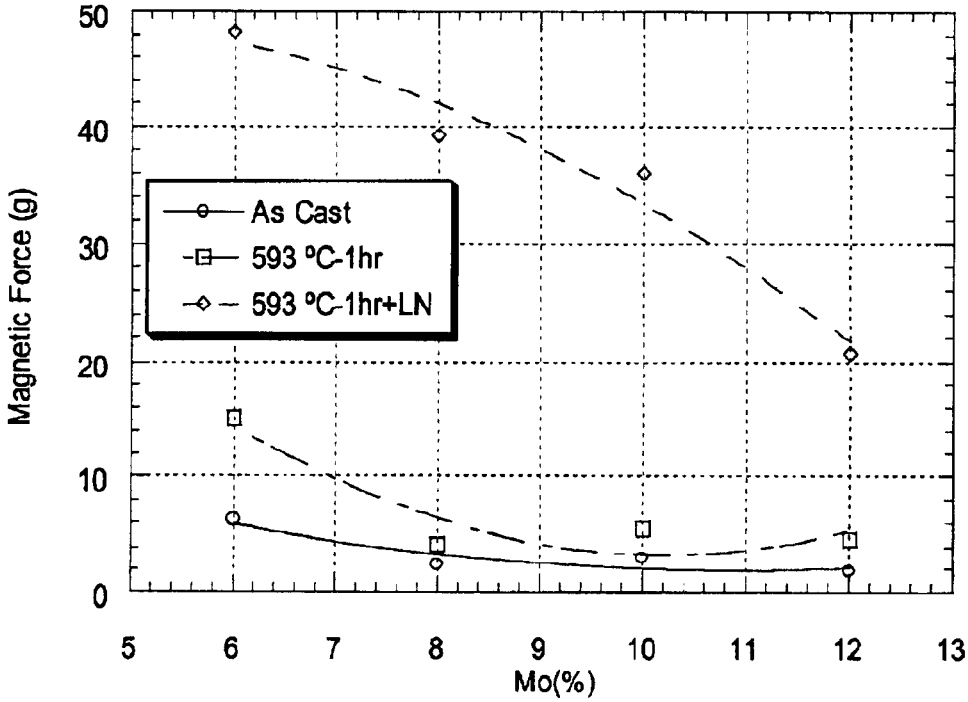
FIG. 3 is a graph illustrating the effect of molybdenum on the magnetic force of example alloys.
Figure 4:
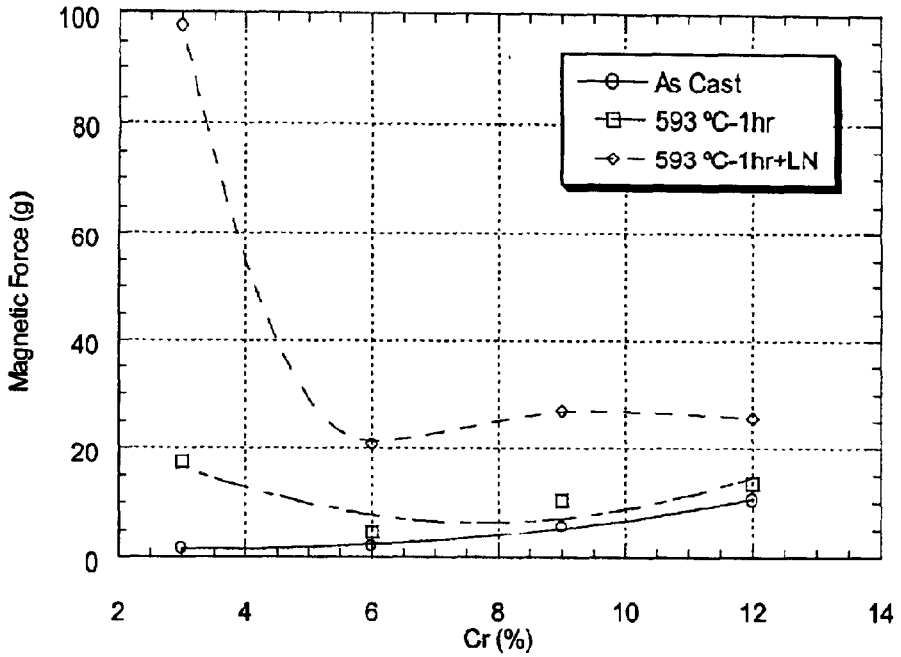
FIG. 4 is a graph illustrating the effect of chromium on the magnetic force of example alloys.

In FIGS. 2 to 4, magnetic force is an indication of the amount of residual austenite in the example alloys. The lower the magnetic force the higher the amount of residual austenite. For nickel base alloy (Eatonite 2) and austenitic iron base alloy (Eatonite 6) the magnetic force is less than 0.5 gram. For fully heat treated martensitic iron base alloys like M2 tool steel and Silchrome XB the magnetic force is greater than 140 grams but less than 170 grams. Therefore, for the first approximation the amount of martensite is assumed to be proportional to the magnetic force and the amount of residual austenite is inversely proportional to the magnetic force.

Figure 5:
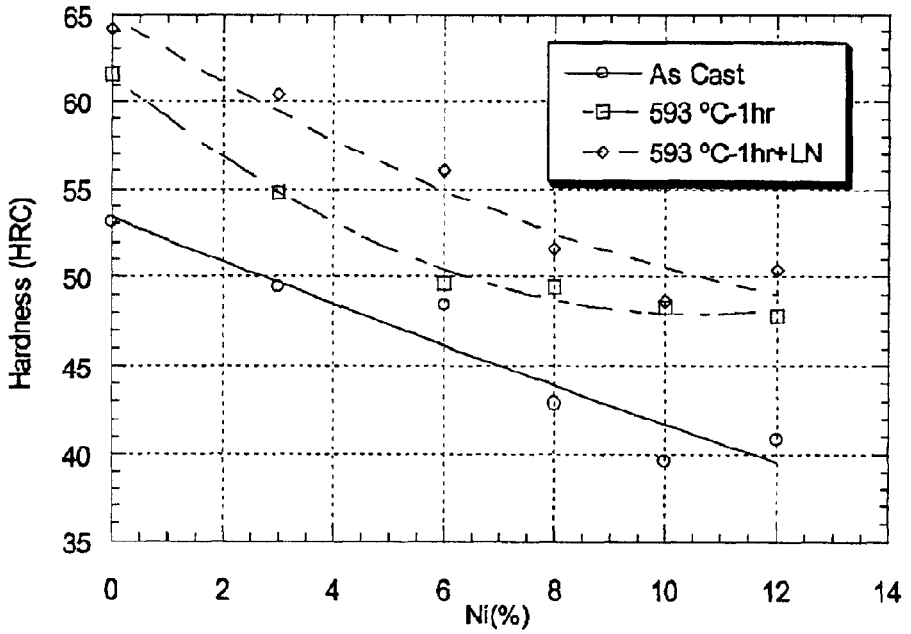
FIG. 5 is a graph illustrating the effect of nickel content on the hardness of example alloys.
Figure 6:
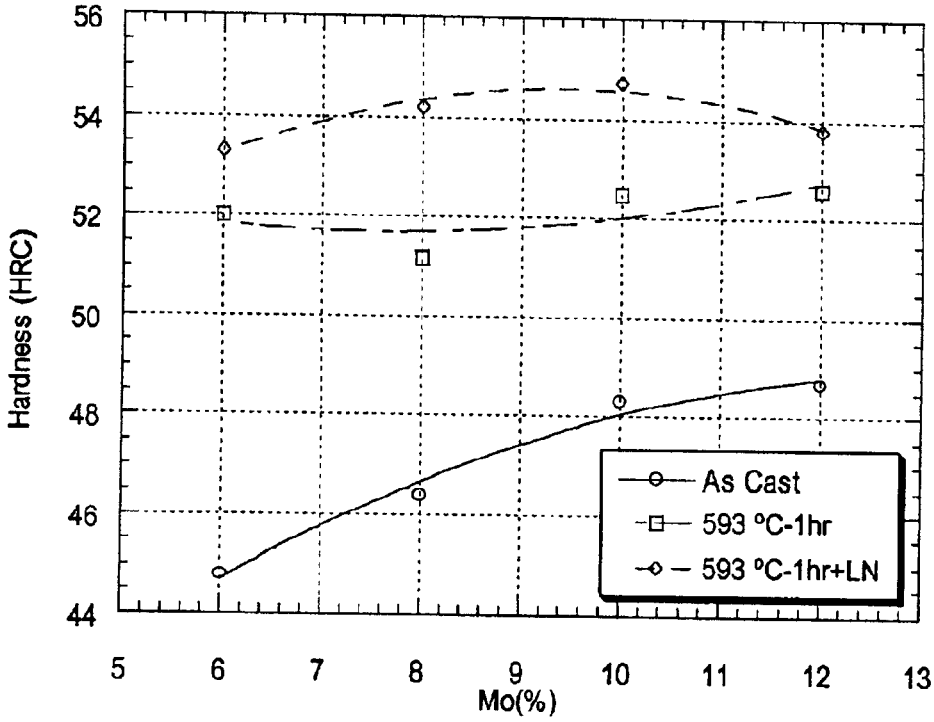
FIG. 6 is a graph illustrating the effect of molybdenum on the hardness of example alloys.
Figure 7:
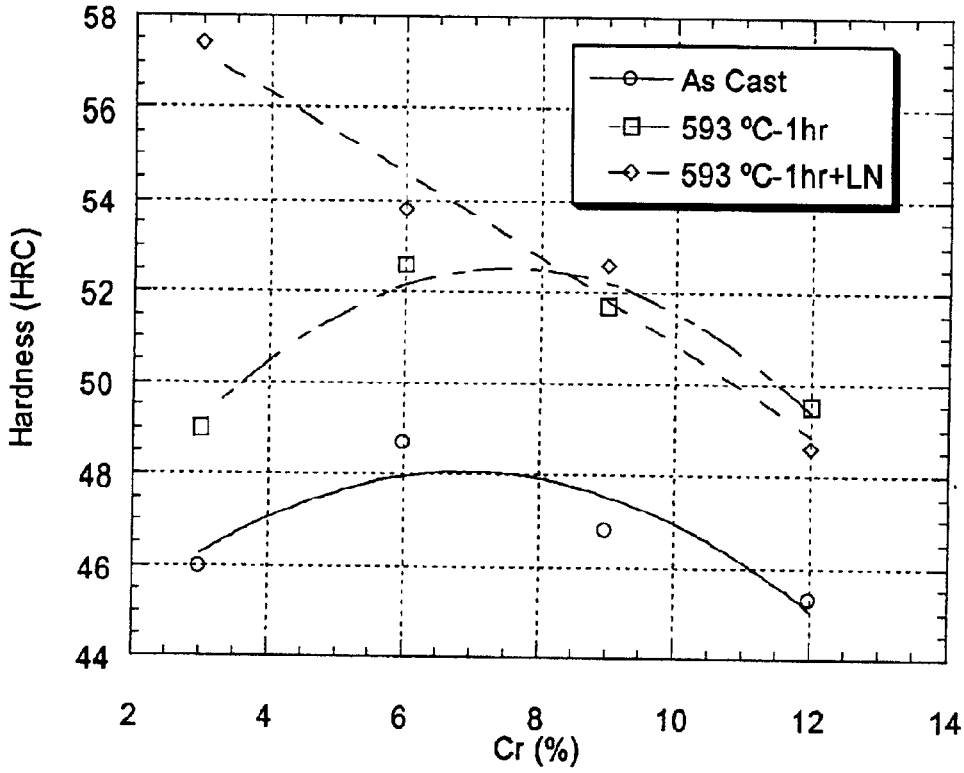
FIG. 7 is a graph illustrating the effect of chromium on the hardness of example alloys.

In FIGS. 5 to 7, the difference in hardness between as-cast and heat treatment conditions of sample alloys is due to precipitation hardening and austenite to martensite transformation. The difference in hardness from chilling treatment is due to austenite to martensite transformation.

Nickel is one of the most important elements in the inventive alloys to control the amount of residual austenite and its stability. As shown in Table 2 and FIG. 2, the amount of residual austenite and the stability of residual austenite linearly increase with nickel addition up to 10.0 wt. % while further increasing in nickel content has little effect to the amount of residual austenite and its stability. To meet the VSI size stability requirement nickel content has to be equal or greater than 8.0 wt % in order to reduce the magnetic force less than 50 grams. Nickel addition will decrease the hardness of the alloy in as-cast, heat treated, and liquid nitrogen chilled conditions, as the amount of residual austenite increase and too much nickel in the inventive alloy will change the matrix into 100% stable austenite. This effect is obvious when nickel increases from zero to 8.0 wt %. Higher nickel content gives a stronger precipitation hardening effect when comparing hardness values in as-cast and heat treated conditions (Table 4 and FIG. 5). Therefore, the optimum nickel content is about 6.0 to 10.0 wt %.

Molybdenum addition can further increasing the stability of residual austenite in sample alloys with enough nickel content. FIG. 3 shows that addition of molybdenum can significantly increase the stability of residual austenite in 6.0 wt % to 12.0 wt % range. The amount of residual austenite after heat treatment and chilling process is more than doubled when molybdenum increases from 6.0 to 12.0 wt %, indicating that molybdenum can effectively make residual austenite more stable. According to FIG. 1, the minimum requirement for residual austenite stability is that its magnetic force should be less than 50 gram after heat treatment and chilling process in liquid nitrogen. Sample alloys (No. 11, 17–20) contain 5.0–15.0 wt % molybdenum; its effect on magnetic force of the alloy is summarized in Table 2 and FIG. 3. Addition of molybdenum can increase sample alloy hardness in as-cast condition but not much effect to the heat and chilling treated sample alloys (FIG. 6).

Tungsten and molybdenum are two refractory elements that are generally believed to be interchangeable as to their effects on the properties of tool steels. However, tungsten shows a different effect than molybdenum to the stability of residual austenite. Sample alloy No. 22 contains 6.0 wt % tungsten and 6.0 wt % molybdenum. Its magnetic force is 48.22 gram, much higher than that in sample alloys No. 17 and No. 18 where molybdenum is 5.0 wt % and 8.0 wt %, respectively. This means that addition of tungsten to 6.0 wt % decreases the stability of residual austenite. Therefore tungsten content in the inventive alloys needs to be controlled less than 6.0 wt %.

Chromium addition has a unique effect to the inventive alloys. As shown in FIG. 5, when chromium content increases from 3.0 to 6.0% there is a huge increase in residual austenite stability. In sample alloy No. 3 with 3.0 wt % chromium in as-cast state, the amount of residual austenite is around 75%. However, only about 30% residual austenite is stable in the alloy after heat treatment and chilling process, indicating the residual austenite in sample alloy No. 3 has a very poor stability. The magnetic force is only about 20 gram in sample alloy No. 11 with 6.0 wt % chromium. Further increasing chromium decreases the residual austenite stability slightly in sample alloys No. 12 and No. 13. Thus, from residual austenite stability view chromium content should be equal or greater than 6.0 wt % in the inventive alloys. Wear test results indicate that the amount of wear increases with chromium content in sample alloys No. 10–13 when chromium content is greater than 6.0 wt % (table 2). Thus, the optimal chromium content is between 6.0–9.0 wt % in the inventive alloys.

Addition of niobium can effectively increase the stability of residual austenite when niobium changes from zero to 1.5 wt % (table 3). However, further increasing niobium to 2.5 wt % (sample alloy No. 16) decreases the stability of residual austenite. Therefore, niobium content in the inventive alloys is between 0 to 2.5 wt %.

The effect of vanadium to the stability of residual austenite is shown in table 3 in sample alloys No. 11 and No. 21. Higher vanadium content decreases the stability of residual austenite. Therefore, vanadium content is between 2.0–4.0 wt %.

Addition of cobalt to 6.0 wt % slightly decreases the stability of residual austenite in sample alloys No. 11 and No. 23 (table 3). Therefore, cobalt needs to be between 0 and 6.0 wt % in the inventive alloys.

Manganese can also be added to the inventive alloys and its effect to the residual austenite is minor when comparing sample alloys No. 11 and No. 26. Manganese content in the inventive alloys is between 0 and 2.0 wt %.

Carbon also has a major effect to the amount of residual austenite in the inventive alloys. Sample alloys No. 7–9 contain 1.6–3.0 wt % without any nickel. The amount of residual austenite increases drastically when carbon is beyond 1.8 wt %. Sample alloys No. 3 and No. 25 contain 2.4 wt % and 0.9 wt % carbon, respectively. The stability of residual austenite is much higher in sample alloy No. 3 than that in sample alloy No. 25 (table 3). Higher carbon is also required to accommodate the addition of chromium, molybdenum, tungsten, vanadium, and niobium to form enough alloy carbides for better wear resistance. Therefore, carbon is between 2.0–3.0 wt % in the inventive alloys.

Silicon decreases the stability of residual austenite as shown in sample alloys No. 11 and 24. Therefore, silicon content needs to be between 1.0–2.0 wt % in the inventive alloys.

It should be appreciated that the alloys of the present invention are capable of being incorporated in the form of a variety of embodiments, only a few of which have been illustrated and described. The invention may be embodied in other forms without departing from its spirit or essential characteristics. It should be appreciated that the addition of some other ingredients, process steps, materials or components not specifically included will have an adverse impact on the present invention. The best mode of the invention may, therefore, exclude ingredients, process steps, materials or components other than those listed above for inclusion or use in the invention. However, the described embodiments are considered in all respects only as illustrative and not restrictive, and the scope of the invention is, therefore, indicated by the appended claims rather than by the foregoing description. All changes that come within the meaning and range of equivalency of the claims are to be embraced within their scope.

What is claimed is:

1. A wear resistant iron base alloy comprising:

a) about 2.0 to about 4.0 wt % carbon b) about 3.0 to about 9.0 wt % chromium;

c) about 1.0 to about 3.0 wt % silicon;

d) about 0 to about 6.0 wt % cobalt;

e) about 5.0 to about 15.0 wt % of molybdenum;

f) about 7.0 to about 15.0 wt % nickel;

g) about 0.0 to about 6.0 wt % vanadium;

h) about 0.0 to about 4.0 wt % niobium;

i) about 0 to about 4.0 wt % manganese;

j) about 0 to about 6.0 wt % tungsten;

k) the balance being iron, totaling 100% by weight.

2. A part for internal combustion engine component comprising the alloy of claim 1.

3. The part of claim 2 where the part is formed by casting the alloy, hardfacing with the alloy either in wire or powder form or the part is formed by powder metallurgy method.

4. The alloy composition of claim 1 wherein the amount of carbon is between about 2.2 wt % and about 2.6 wt %.

5. The alloy composition of claim 1 wherein the amount of chromium is between about 5.0 wt % and about 8.0 wt %.

6. The alloy composition of claim 1 wherein the amount of silicon is between about 1.5 wt % and about 2.5 wt %.

7. The alloy composition of claim 1 wherein the amount of cobalt is about 0 wt %.

8. The alloy composition of claim 1 wherein the amount of molybdenum is between about 6.0 wt % and about 12.0 wt %.

9. The alloy composition of claim 1 wherein the amount of nickel is up to about 12 wt %.

10. The alloy composition of claim 1 wherein the amount of vanadium is between about 1.0 and about 3.0 wt %.

11. The alloy composition of claim 1 wherein the amount of niobium is between about 1.0 wt % and about 2.0 wt %.

12. The alloy composition of claim 1 wherein the amount of manganese is between about 0 and about 0.8 wt %.

13. The alloy composition of claim 1 wherein the amount of tungsten is between about 0.5 and about 2.5 wt %.

14. The alloy composition of claim 1 wherein the amount of iron is greater than about 45.0 wt %.

15. A wear resistant valve insert comprising

An iron base alloy comprising:

a) about 2.0 to about 4.0 wt % carbon b) about 3.0 to about 9.0 wt % chromium;

c) about 1.0 to about 3.0 wt % silicon;

d) about 0 to about 6.0 wt % cobalt;

e) about 5.0 to about 15.0 wt % of molybdenum;

f) about 7.0 to about 15.0 wt % nickel;

g) about 0.0 to about 6.0 wt % vanadium;

h) about 0.0 to about 4.0 wt % niobium;

i) about 0 to about 4.0 wt % manganese;

j) about 0 to about 6.0 wt % tungsten;

k) the balance being iron, totaling 100% by weight.

16. The alloyed composition of claim 1 wherein the amount of tungsten is between 0.5 and 6 wt %.

17. The alloyed composition of claim 1 wherein the amount of tungsten is between about 2.5 wt % and 6 wt %.

18. The alloyed composition of claim 15 wherein the amount of tungsten is between 0.5 and 6 wt %.

19. The alloyed composition of claim 15 wherein the amount of tungsten is between about 2.5 wt % and 6 wt %.

20. A wear resistant iron base alloy comprising:

l) about 2.0 to about 4.0 wt % carbon m) about 3.0 to about 9.0 wt % chromium;

n) about 1.0 to about 3.0 wt % silicon;

o) about 0 to about 6.0 wt % cobalt;

p) about 5.0 to about 15.0 wt % of molybdenum;

q) about 3.0 to about 15.0 wt % nickel;

r) about 0.0 to about 6.0 wt % vanadium;

s) about 0.0 to about 4.0 wt % niobium;

t) about 0 to about 4.0 wt % manganese;

u) about 0 to about 6.0 wt % tungsten;

v) the balance being iron, totaling 100% by weight;

having a magnetic attraction force of about 90 or less after the alloy has been cast, heated to about 1100° F. for about one hour and subjected to liquid nitrogen.

21. A part for internal combustion engine component comprising the alloy of claim 20.

22. The part of claim 21 where the part is formed by casting the alloy, hardfacing with the alloy either in wire or powder form or the part is formed by powder metallurgy method.

23. The alloy composition of claim 20 wherein the amount of carbon is between about 2.2 wt % and about 2.6 wt %.

24. The alloy composition of claim 20 wherein the amount of chromium is between about 5.0 wt % and about 8.0 wt %.

25. The alloy composition of claim 20 wherein the amount of silicon is between about 1.5 wt % and about 2.5 wt %.

26. The alloy composition of claim 20 wherein the amount of cobalt is about 0 wt %.

27. The alloy composition of claim 20 wherein the amount of molybdenum is between about 5.0 wt % and about 15.0 wt %.

28. The alloy composition of claim 20 wherein the amount of nickel is between about 7.0 and about 12 wt %.

29. The alloy composition of claim 20 wherein the amount of vanadium is between about 1.0 and about 3.0 wt %.

30. The alloy composition of claim 20 wherein the amount of niobium is between about 1.0 wt % and about 2.0 wt %.

31. The alloy composition of claim 20 wherein the amount of manganese is between about 0 and about 0.8 wt %.

32. The alloy composition of claim 20 wherein the amount of tungsten is between about 0.5 and about 2.5 wt %.

33. The alloy composition of claim 20 wherein the amount of iron is greater than about 45.0 wt %.

* * * * *